US005795269A

United States Patent [19]

Bawtree et al.

[11] Patent Number: 5,795,269

[45] Date of Patent: Aug. 18, 1998

[54] GAIT THERAPY AID

[75] Inventors: Bruce Allan Bawtree; Kevin James Trawin, both of Victoria; Jason Edward Pope, Mission, all of Canada

[73] Assignee: Innovative Therapy Aids Inc., Victoria, Canada

[21] Appl. No.: 654,101

[22] Filed: May 25, 1996

[51] Int. Cl.[6] ..... A63B 22/00

[52] U.S. Cl. ..... 482/66; 482/68; 434/255; 601/23; 601/35

[58] Field of Search ..... 486/51, 66–69, 486/70, 71; 434/255; 601/23, 24, 26, 33–35, 5; 135/65, 67; 472/15, 21–24

[56] References Cited

U.S. PATENT DOCUMENTS

| | | | |
|---|---|---|---|
| 219,439 | 9/1879 | Blend | 482/70 |
| 658,464 | 9/1900 | Reinli | 482/68 |
| 2,210,269 | 8/1940 | Taylor | 482/67 |
| 2,772,881 | 12/1956 | Fundom | 482/70 |
| 2,969,060 | 1/1961 | Swanda et al. | 601/98 |
| 3,582,069 | 6/1971 | Flick et al. | 482/70 |
| 3,824,994 | 7/1974 | Soderberg et al. | 482/51 |
| 5,040,785 | 8/1991 | Charnitshi | 482/51 |
| 5,044,355 | 9/1991 | Reopelle | 482/70 |
| 5,224,562 | 7/1993 | Reed . | |
| 5,390,753 | 2/1995 | Parker . | |
| 5,467,793 | 11/1995 | Hart | 135/67 |

OTHER PUBLICATIONS

Misc. Catalogue Enkries.

Evalwation of a Device Exercise the Hip Extension Muscles 7 & Children with Cerebral Palsey A Clinical Field Study. The Hart Walker.

*Primary Examiner*—Jeanne M Clark

*Attorney, Agent, or Firm*—C. A. Rowley

[57] ABSTRACT

Gait therapy aid or trainer controls the movement of the feet of the user to travel in substantially a straight line, coordinates the walking movement of the user with that of the aid so that movement of the body of the user and of the training device in the direction of walking are essentially the same by interconnecting a pair of foot pieces and the body of the device via a motion controlling mechanism.

20 Claims, 2 Drawing Sheets

GAIT THERAPY AID

FIELD OF INVENTION

The present invention relates to a therapeutic aid, more particularly, the present invention relates to a therapeutic aid for gait training.

BACKGROUND OF THE INVENTION

Many disabled person, particularly children with nervous disorders such as cerebral palsy or Spina Bifida have difficulty even in learning to walk. Older people, sometimes incur the same difficulties, however, a simple, relatively inexpensive equipment is available to provide therapy and training to facilitate walking of such patients.

There are a number of walker type devices which help to support the patient as he or she is walking or attempting to walk, some are wheeled, some are not and some are motorized see for example U.S. Pat. Nos. 5,390,753 issued Feb. 21, 1995 to Parker or 5,234,562 issued Jul. 6, 1993 to Reed. A peddle type device is shown and evaluated in "Evaluation of a Device to Exercise the Hip Extensor Muscles in Children with Cerebral Palsy: a Clinical and Field Study" King et al., pp. 566 & 567 RESNA '93 Jun. 12–17, 1993.

BRIEF DESCRIPTION OF THE PRESENT INVENTION

It is an object of the present invention to provide a gait therapy device which controls the action of the feet of a user to aid a patient in developing a proper gait.

Broadly, the present invention relates to a gait trainer comprising a pair of foot pieces, each adapted to receive a foot of a user, a frame, a pair of mounting blocks, means on said frame, means for guiding said mounting blocks for movement along selected substantially parallel paths, a motion control means interconnecting said blocks and said frame so that movement of one of said blocks along its said path in one direction causes relative movement between said frame and an other of said blocks along its said path in a direction opposite said one direction and movement of said frame one half a distance of movement of said one block in said one direction, a first arm means connecting one of said pair of foot piece to said one of said blocks and a second arm means connecting another of said pair of foot pieces to said other of said blocks, each of said arm means and its said block interconnecting with their said foot piece to limit movement of their said foot piece to be substantially in said one or said opposite direction.

Preferably, each said arm means will comprise a rigid member pivotably connected to said block means to pivot on an axis substantially perpendicular to said one direction.

Preferably, each said foot pieces will be pivotably mounted adjacent to an end of its said rigid member remote from said block to pivot relative to said member on a pivotal axis, said pivotal axis being positioned to accommodate ankle movement of said user.

Preferably said pivotal axis is perpendicular to said one direction.

Preferably, each of said one and said other arm means comprise a rigid link pivotably mounted at one end to its foot piece for pivotal movement around a first axis and pivotal mounted adjacent to its end remote from said one end to said block for movement about a second axis, said first and second axis being substantially parallel.

Preferably, said motion control means comprise a loop means, first and second guiding pulleys mounted in spaced relationship on said frame spaced apart in said one direction, said first and second blocks each being connected to said loop means for movement of said loop means.

Preferably said pulleys define a first section of said loop means extending between said pulleys on one side of said pulleys and a second section on the opposite side of said pulleys and one of and blocks is connected to said one section and the other of said blocks is connected to said other section.

Preferably, said frame will further include wheels to facilitate movement of said frame along a support surface.

Preferably, said frame will further include support bars in position to be gripped by the hands of a user operating the trainer.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Before describing the invention the action of walking will be described as it is believed this will facilitate understanding the operation of the invention. Movement of the lower body of a person during walking may be broken down into the movement of the foot and the movement of the central mass of the body. Generally, the foot movement is composed of two main motions, i.e. a vertical motion and a horizontal motion. There is a direct relationship between the horizontal movement of the foot and the movement of the center of mass or center of gravity of the body during normal walking such that the foot in each step travels in the direction of walking twice the distance of the center of mass moves, however, because each foot overlaps the other by one half a stride over a series of steps, the overall distance traveled by the feet and the center of mass is obviously the same.

The present invention duplicates these motions with its main frame following the body movement and the foot pieces that are powered by the user to power the movement of the frame of the trainer moving twice the distance the frame moves.

Figure 1:
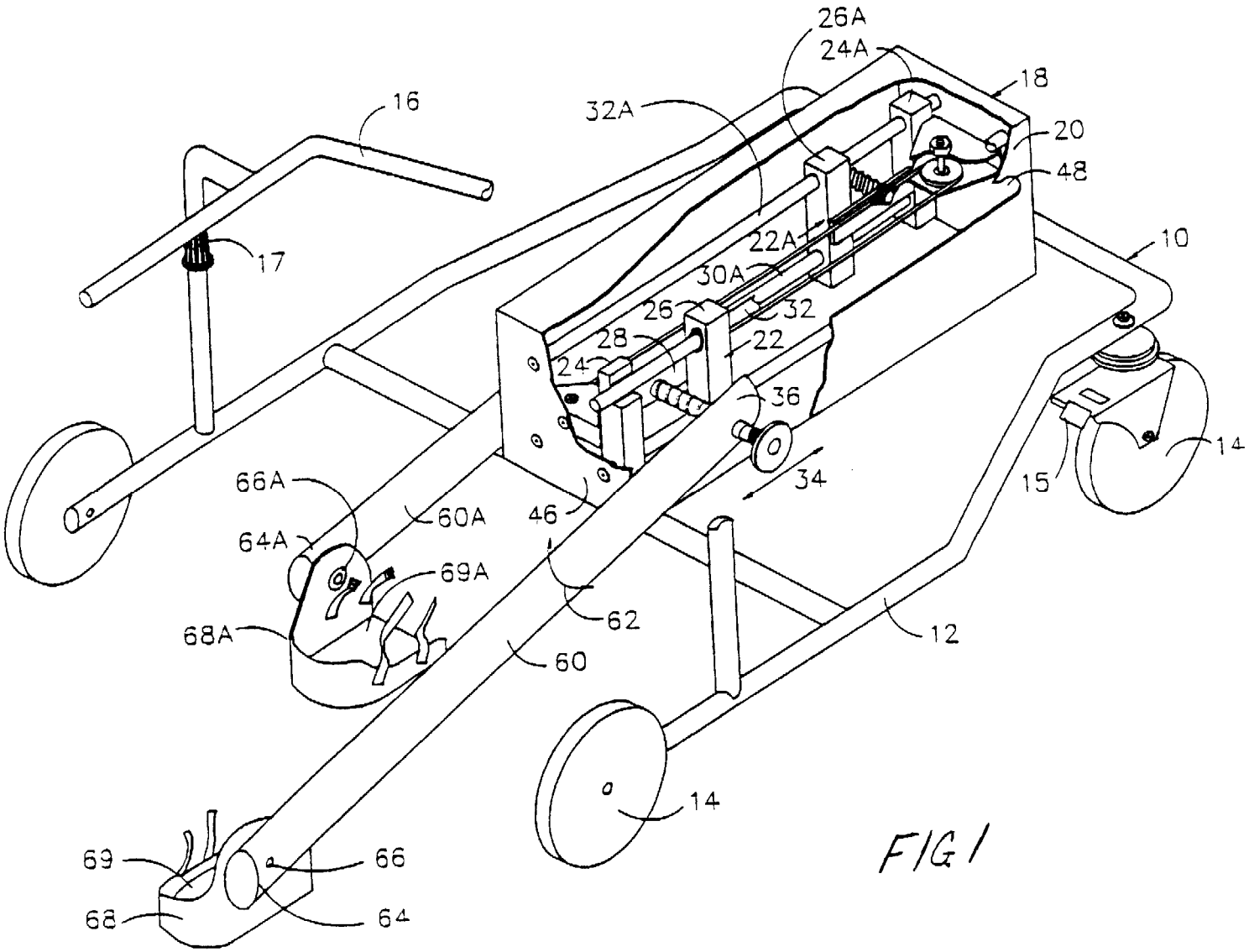
FIG. 1 is an isometric view of the present invention with parts broken away and illustrating the principles of the present invention.

Referring to FIG. 1, the present invention comprises a main frame 10 which in the illustrated arrangement is made of a plurality of interconnected tubular member 12 and is supported on wheels 14, one at each corner of the frame 12 (only three shown). All of these wheel may be aligned to travel in a specific direction, i.e. the direction the user will be walking. However, if desired, the each of the front wheels 14 may be mounted to pivot about a vertical axis or may be locked in a selected position by a suitable latching mechanism 15.

The frame 10 further include at least one gripper bar 16 that may be grasp by the user to help to balance when using the invention. This bar 16 may be mounted to the frame 12 in a manner so that it is vertically adjustable, for example by a compression coupling 17.

Mounted on the frame 12 preferably along it longitudinal axis extending in the direction of intended movement of the frame during operation is a motion control system 18 that includes a housing 20 that is fixed to and forms part of the frame 12 that encloses the control and synchronizing mechanisms of the motion controller 18.

As illustrated, the motion controller 18 comprises a first guiding block 22 composed of a pair of vertical bars 24 and 26 spaced in the direction of the movement of the block and interconnected by a cross member 28.

The bars 24 and 26 are provided with bearings, not shown, that receive spaced parallel guide rods 30 and 32 that are fixed to the housing 20 and restrict the block 22 to reciprocal movement in a straight line in a first direction as indicated by the arrow 34 or in an opposite direction.

A similar block 22A the parts of which are indicated by the same reference numerals followed by the letter A is guided for movement in the same manner and in the same direction via similar guide rods 30A and 32A.

Figure 2:
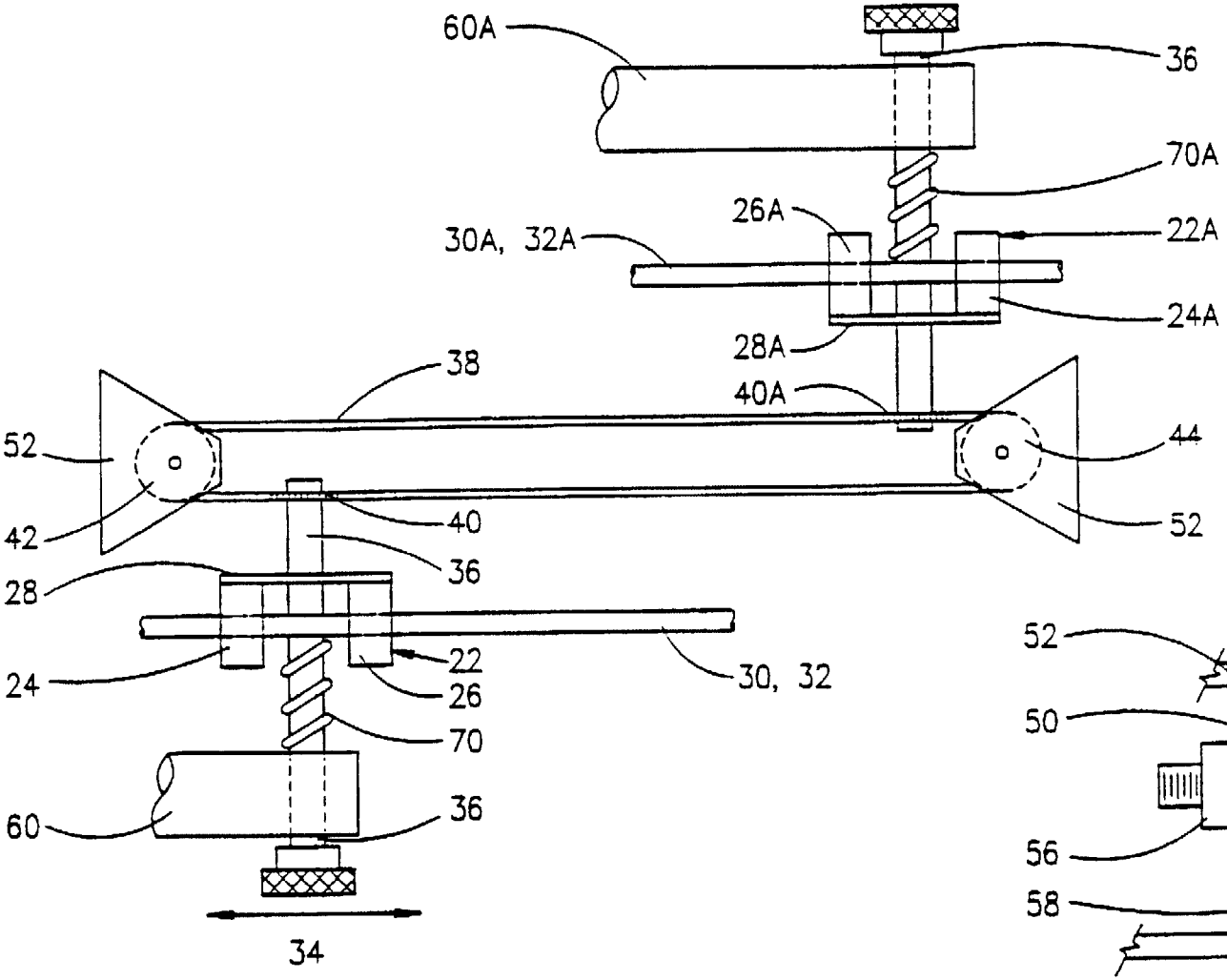
FIG. 2 is a partial plan view, with parts omitted, illustrating more clearly a preferred type of motion control system.

Projecting from the guiding blocks 22 and 22A are bearing rods 36 and 36A respectively each of which extends substantially perpendicular to the direction 34 (see also FIG. 2).

The inner ends of the bearing rods 36 and 36A are connected to a loop 38 as indicated schematically at 40 and 40A. The loop 38 is formed around a pair of spaced pulleys 42 and 44 which are mounted to the end walls 46 and 48 respectively at axial ends of the housing 20 (see FIG. 1). One of the bearing rods 36 connects its block 22 to one side of the loop 38 as defined by the run of the loop on one side of the pulleys 42 and 44 and the other of the bearing rods 36A connects its block 22A to the run of the loop 38 on the other side of the pulleys 42 and 44.

Figure 3:
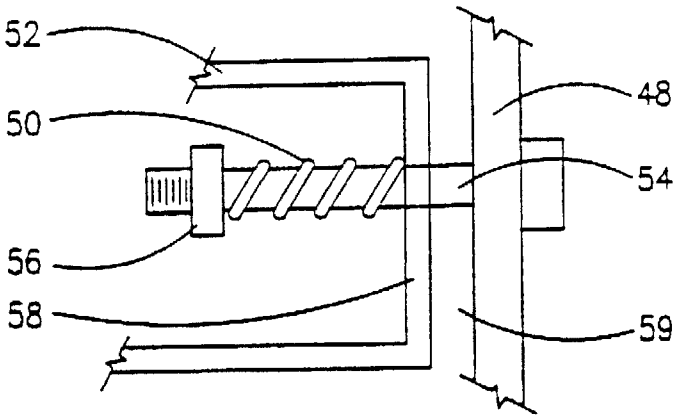
FIG. 3 is a partial side elevation illustrating a spring mounting of a pulley mounting flange.

The loop 38 may be held in position by any suitable means e.g. a fixed length to the loop so that it is trapped within the flanges of the pulleys 42 and 44 or by tension which may be applied for example by tension in the loop 38 or by biasing the two pulleys 42 and 44 apart. In the embodiment shown in FIG. 3, this is accomplish by interposing a spring 50 between the pulley housing 52 mounting one or the other of the pulleys 42 or 44 or both and tending to force the pulley housing 52 toward the adjacent end of the housing 20 i.e. in a direction away from its opposite pulley. In the illustrated arrangement of FIG. 3, the pulley 44 mounting includes bolts 54 extending from the end wall 48 through the pulley housing 52 and the spring 50 is wound about the bolt 54 and compressed between the nut 56 and the wall 58 of the housing 52 thereby to tend to narrow the gap 59 between the front wall 48 and the wall 58 and force the pulleys 42 and 44 apart. When loop length or tension is used the housings 52 will be firmly bolted against the wall 48.

Loop 38 may be any suitable system such as a cable, belt, chain, etc.

It is apparent that the block 22 is positioned on one side of the pulleys 42 and 44 so that it moves along the glides 30 and 32 when the loop 38 is moved. Similarly, the block 22A is mounted on the opposite sides of the loop and moves with the loop 38.

In this arrangement, it will be apparent that if the housing 20 and frame 10 do not move, any movement of the block 22 will result in an equal and opposite movement of the block 22A and vice versa. However, if the housing 20 and frame 10 are permitted to move, then movement of say the block 22 in the first direction 34 while holding the block 22A fixed in space (e.g. by foot pressure on the foot piece to be described below) results in movement of the frame 10 a distance equal to one half the distance moved by the block 22. Similarly, if the block 22A is moved and the block 22 held fixed in space, the frame 10 moves in the same direction as the block 22A but half the distance.

It will be apparent then that the movement of the blocks 22 and 22A correspond with the horizontal movement of the foot of the wearer while movement of the frame corresponds with the movement of the body of the user during walking.

To complete the device, suitable links 60 and 60A are pivotably mounted on the shafts or rods 36 and 36A respectively as indicated by the arrow 62 and pivotably mounted adjacent to the free end 64 (64A) of the link or arm 60 (60A) via a pivot pin 66 (66A) is a foot piece 68 (68*a*) into which the foot of the wearer is received and held. This position of the axis of rotation of the foot piece 68 (68A) on the pin 66 (66A) is positioned relative to the sole 69 (69A) of the foot piece 68 (68A) to be substantially aligned with the ankle joint of the user, preferably the sole 69 (69A) will extend under the heal but not as far forward as the balls of the foot so as not to interfere with toe movement.

If desired a suitable spring 70 (70A) may be interposed between the block 22 (22A) and the arm or link 60 (60A) to bias link 60 (60A) away from the block 22 (22A) and if desired to provide some further resistance to motion of the link 60 (60A) along the arc 62 and/or to bias the foot piece 68 toward the support surface (floor).

In operation, the user is positioned with his feet in the foot pieces 68 and 68A and simply commences to walk. Movements of the foot pieces 68 and 68A are restricted substantially to movements in the direction parallel to the plane of the arrow 34 thereby ensuring that the user walks in the correct direction. By clamping or otherwise ensuring the foot and foot piece travel together with limited movement therebetween inward or outward movement or twisting of foot is substantially prevented.

It will be apparent that the present invention, with proper use, may be effective battling foot eversion (or inversion) i.e., misalignment of the foot to the direction of travel or leg abduction (or adduction), the distance between the feet when walking, (which may be adjusted by positioning the arms 60 and 60A relative to the blocks 22 and 22A to that required for the patient). Another common problem, namely, scissoring which is movement of the legs to tend to cross during walking may also be impaired with the present invention.

Clearly, the present invention provides a useful tool for helping disabled persons, particularly small children, in learning to walk properly.

The motion control mechanism is described as a loop or cable mechanism. However, it will be apparent that other devices may be used to impart essentially the same relative movement between the frame and the two blocks, 22 and 22A. For example, each of the blocks 22 and 22A could be provided with racks extending substantially parallel to the direction of movement and a suitable pinion positioned between the racks and in engagement therewith. By mounting the pinion on a shaft fixed to the housing 20 and extending substantially perpendicular to the direction of travel of the racks essentially the same movement characteristics of the block and the casing 20 or the frame 10 are produced.

Having described the invention, modifications will be evident to those skilled in the art without departing from the scope of the invention as defined in the appended claims.

We claim:

1. A gait trainer comprising a pair of foot pieces, each adapted to be connected with a foot of a user for movement by movement of the foot of a user, said foot pieces are configured to be free to move into contact with a supporting surface along which said trainer is moved by walking movements of a user, a frame, means for allowing movement of said frame by a user, a pair of mounting blocks operatively connected to said frame, means for guiding said mounting blocks for reciprocal movement along selected substantially parallel paths in one or an opposite direction, a motion control means mounted on said frame, a first arm means connecting one of said pair of foot pieces to said one of said blocks and a second arm means connecting another of said pair of foot pieces to said other of said blocks, each of said arm means interconnecting its said block with its said foot piece to limit movement of its said foot piece to be substantially in said one or said opposite directions, said motion control means interconnecting said pair of mounting blocks for reciprocal movements in a pair of substantially parallel paths and ensuring that movement of one of said pair of mounting blocks relative to said frame in said one direction results in equal movement of the other of said pair of mounting blocks relative to said frame but in said opposite direction and movement of said frame relative to the supporting surface by distance equal to one half a distance of movement of said one block in said one direction when said other of said pair of blocks is prevented from movement relative to the supporting surface when said foot piece to which it is interconnected is pressed against the supporting surface during walking of said user.

2. A gait trainer as defined in claim 1 wherein each said arm means comprises a rigid member pivotably connected to said block to pivot relative to said block on an axis substantially perpendicular to said one direction.

3. A gait trainer as defined in claim 2 therein each said foot pieces is pivotably mounted adjacent to an end of its said rigid member remote from said block to pivot relative to said member on a pivotal axis, said pivotal axis being positioned to accommodate ankle movement of a user.

4. A gait trainer as defined in claim 3 wherein said pivotal axis is perpendicular to said one direction.

5. A gait trainer as defined in claim 1 wherein each of said first and said second arm means comprise a rigid link pivotably mounted at one end to its foot piece for pivotal movement around a first axis and pivotal mounted adjacent to its end remote from said one end to said block for movement about a second axis, said first and second axis being substantially parallel.

6. A gait trainer as defined in claim 1 wherein said motion control means comprise a loop means, first and second guiding pulleys mounted in spaced relationship on said frame spaced apart in said one direction and means connecting each of said first and second blocks to said loop means for movement of said loop means.

7. A gait trainer as defined in claim 6 wherein said pulleys define a first section of said loop means extending between said pulleys on one side of said pulleys and a second section on the opposite side of said pulleys and one of said blocks is connected to said one section and the other of said blocks is connected to said other section.

8. A gait trainer as defined in claim 7 wherein said means for allowing movement of said frame has wheels to facilitate movement of said frame along the supporting surface.

9. A gait trainer as defined in claim 2 wherein said motion control means comprise a loop means, first and second guiding pulleys mounted in spaced relationship on said frame spaced apart in said one direction and means connecting each of said first and second blocks to said loop means for movement of said loop means.

10. A gait trainer as defined in claim 9 wherein said pulleys define a first section of said loop means extending between said pulleys on one side of said pulleys and a second section on the opposite side of said pulleys and one of said blocks is connected to said one section and the other of said blocks is connected to said other section.

11. A gait trainer as defined in claim 10 wherein said means for allowing movement of said frame comprises wheels to facilitate movement of said frame along the supporting surface.

12. A gait trainer as defined in claim 3 wherein said motion control means comprise a loop means, first and second guiding pulleys mounted in spaced relationship on said frame spaced apart in said one direction and means connecting each of said first and second blocks to said loop means for movement of said loop means.

13. A gait trainer as defined in claim 12 wherein said pulleys define a first section of said loop means extending between said pulleys on one side of said pulleys and a second section on the opposite side of said pulleys and one of said blocks is connected to said one section and the other of said blocks is connected to said other section.

14. A gait trainer as defined in claim 13 wherein said means for allowing movement of said frame comprises wheels to facilitate movement of said frame along the supporting surface.

15. A gait trainer as defined in claim 4 wherein said motion control means comprise a loop means, first and second guiding pulleys mounted in spaced relationship on said frame spaced apart in said one direction and means connecting each of said first and second blocks to said loop means for movement of said loop means.

16. A gait trainer as defined in claim 15 wherein said pulleys define a first section of said loop means extending between said pulleys on one side of said pulleys and a second section on the opposite side of said pulleys and one of said blocks is connected to said one section and the other of said blocks is connected to said other section.

17. A gait trainer as defined in claim 16 wherein said means for allowing movement of said frame comprises wheels to facilitate movement of said frame along the supporting surface.

18. A gait trainer as defined in claim 5 wherein said motion control means comprise a loop means, first and second guiding pulleys mounted in spaced relationship on said frame spaced apart in said one direction and means connecting each of said first and second blocks to said loop means for movement of said loop means.

19. A gait trainer as defined in claim 18 wherein said pulleys define a first section of said loop means extending between said pulleys on one side of said pulleys and a second section on the opposite side of said pulleys and one of said blocks is connected to said one section and the other of said blocks is connected to said other section.

20. A gait trainer as defined in claim 19 wherein said means for allowing movement of said frame comprises wheels to facilitate movement of said frame along the supporting surface.

* * * * *